US007243818B2

(12) United States Patent
Jones

(10) Patent No.: US 7,243,818 B2
(45) **Date of Patent: *Jul. 17, 2007**

(54) SYSTEM AND METHOD FOR DISPENSING BEVERAGES

(76) Inventor: Charles H. Jones, 1504 Macy Dr., Roswell, GA (US) 30076

( * ) Notice: Subject to any disclaimer, the term of this patent is extended or adjusted under 35 U.S.C. 154(b) by 0 days.

This patent is subject to a terminal disclaimer.

(21) Appl. No.: 11/332,273

(22) Filed: Jan. 17, 2006

(65) Prior Publication Data

US 2006/0113323 A1 Jun. 1, 2006

Related U.S. Application Data

(63) Continuation-in-part of application No. 10/436,067, filed on May 13, 2003, now Pat. No. 6,994,231.

(60) Provisional application No. 60/379,773, filed on May 14, 2002.

(51) Int. Cl.
*B67D 5/56* (2006.01)

(52) U.S. Cl. ..... 222/129.1; 222/129.2

(58) Field of Classification Search ..... 222/129.1, 222/129.2

See application file for complete search history.

(56) References Cited

U.S. PATENT DOCUMENTS 3,586,214 A 6/1971 Diebel
4,042,151 A 8/1977 Uttech
4,160,512 A 7/1979 Cleland
4,364,493 A 12/1982 Raynes et al.
4,469,137 A 9/1984 Cleland
4,535,917 A 8/1985 Trewhella
4,817,825 A 4/1989 Freese
4,986,447 A 1/1991 McCann et al.
5,048,726 A 9/1991 McCann et al.
5,203,474 A 4/1993 Haynes
5,207,148 A 5/1993 Anderson et al.
5,241,988 A 9/1993 Haynes
5,415,326 A 5/1995 Durham et al.
5,842,617 A 12/1998 Younkle et al.
5,845,815 A 12/1998 Vogel
6,712,242 B2 3/2004 Friedman
6,766,656 B1 * 7/2004 Crisp et al. ..... 62/389
6,994,231 B2 * 2/2006 Jones ..... 222/129.1

* cited by examiner

*Primary Examiner*—Philippe Derakshani
(74) *Attorney, Agent, or Firm*—Clark & Brody

(57) ABSTRACT

A beverage dispensing system and method employs a beverage concentrate, and optionally liquid sweeteners, and beverage flavorings to provide a tailored single beverage output of high volume. A venturi mixing device is utilized with water as the motive force to mix the beverage components together. Control valves are provided for each component to regulate the amounts and ratios to produce a desired beverage.

14 Claims, 6 Drawing Sheets

SYSTEM AND METHOD FOR DISPENSING BEVERAGES

This application is a continuation in part application based on application Ser. No. 10/436,067 filed on May 13, 2003, now U.S. Pat. No. 6,994,231, which claims priority under 35 USC 119 based on provisional patent application No. 60/379,773 filed on May 14, 2002.

FIELD OF THE INVENTION

The present invention is directed to a system and method for dispensing beverages, and particularly to one that dispenses high volumes at rates ranging from 2.0 to 10.0 ounces per second of a concentrated beverage.

BACKGROUND ART

In the field of dispensing beverages, it is known to use a venturi mixing device for mixing beverage components together to produce an output.

One problem with present systems is that many are not geared for high volume output. In addition, systems lack the capability of producing a single customized output using one or more beverages or beverage concentrates. Accordingly, a need exists to provide improved beverage dispensing methods and systems.

The present invention solves this need by providing a method and system, which provides a single flavored, and sweetened/unsweetened beverage output using a single beverage base or concentrate or a combinations of such bases.

SUMMARY OF THE INVENTION

It is a first object of the present invention to provide an improved method of dispensing beverages.

Another object of the invention is to provide a system that produces a flavored and sweetened/unsweetened beverages.

A further object of the invention is a system that uses a venturi mixing device to mix a number of beverage components, e.g., a base beverage, a number of flavorings, water, and a sweetener into a single beverage output.

Another object of the invention is an improved system and method, which dispenses sweetened and flavored tea or fruit juice at rates ranging between 2 and 10 ounces per second.

One other object of the invention is a system that allows for housing movement to facilitate its operation.

Still another object of the invention is a system and method which allows selection of different beverage concentrates for dispensing at a high output, and through a nozzle and an elongated flexible hose arrangement that allows for easy dispensing.

In satisfaction of the foregoing objects and advantages, the present invention provides an improvement in the rapid dispensing of beverages that use water and a venturi mixing device. In one mode, the invention entails a system having a liquid beverage base source with a first control valve disposed between a first inlet of the venturi mixing device and the liquid beverage base source, at least one liquid sweetener source with a second control valve disposed between a venturi chamber of the venturi mixing device, and at least one liquid beverage flavoring source with a third control valve disposed between a third inlet to the venturi chamber of the venturi mixing device and the liquid beverage flavoring source. A water supply assembly is connected to the venturi mixing device for supplying pressure regulated water as the motive force for operation of the venturi mixing device. A single beverage outlet from the venturi mixing device has a dispensing valve; and a means for controlling the taste of the beverage output is provided by controlling the input of each source into the venturi chamber.

The regulated and filtered water inlet further comprises a water supply assembly comprising at least a pressure regulator, and a check valve disposed upstream of the venturi mixing device. A plurality of beverage flavoring sources can be provided, each of the plurality of beverage flavoring sources having a control valve, and the venturi chamber is capable of producing a high volume beverage output flow on the order of least about 2–12 ounces per second, more preferably 3.2–10 ounces per second, and even more preferably up to 8.0 ounces per second.

The control means can include a memory means for remembering ratios of beverage base, liquid sweetener, and beverage flavorings for a particular beverage flavor, and means for replicating said particular beverage flavor using the remembered ratios.

This mode of the invention is also an improvement in methods of dispensing beverages using a venturi chamber, a source of a liquid beverage base, and water as the motive force for dispensing. The improvement comprises providing a source of at least one liquid sweetener, providing a source of at least one liquid beverage flavoring, and mixing the water with a controlled amount of at least one liquid sweetener and at least one liquid beverage flavoring with a controlled amount of the liquid beverage base to produce a single beverage output using the venturi chamber, and outputting a single beverage from the venturi chamber. The output is a high volume output of at least about 3.2–12 ounces per second.

A plurality of liquid beverage flavorings can be provided, and controlled amounts of at least two of the plurality of liquid beverage flavorings can be mixed to produce the single beverage.

The invention also entails another system which uses a plurality of concentrated beverage input lines, each line having a control valve therein and a switching valve having a plurality of inputs, each input in communication with a respective beverage input line. An output line is provided that is in communication with a concentrate input of the venturi mixing device. A water supply assembly is connected to a water input of the venturi mixing device for supplying pressure-regulated water as the motive force for operation of the venturi mixing device, and a single beverage outlet assembly in communication with an output of the venturi mixing device is provided. The single beverage outlet assembly has a flexible hose extending from the venturi mixing device and a dispensing valve at an end of the flexible hose. The input lines, the switching valve, and water supply assembly are enclosed in a housing.

The input lines can have different dimensions to accommodate concentrates of different viscosities, and the dispensing valve can include a nozzle body with an elongated outlet member with an outlet opening at an end thereof, the nozzle body designed for grasping by a user. An operating lever is provided that extends from the nozzle body. A length of flexible hose interconnects the nozzle body and the venturi mixing device for dispensing beverage at locations that are remote from the system itself. A splitter can also be used for dividing the output of the venturi mixing device into two outputs, one output connecting to the single beverage outlet assembly and the other output passing through a flow control valve to produce a diffused flow output. The diffused flow output has a rate less than an output from the single beverage outlet assembly so that smaller containers are more easily filled. A control means can also be used whereby the input of the concentrated beverages and water are controlled to produce a desired output or allow for selection of a desired input.

As part of the second embodiment, a method of dispensing beverages using a venturi chamber, a source of a liquid beverage base, and water as the motive force for dispensing, the improvement comprises providing a source of a plurality of flavored liquid concentrate, selecting one of the plurality of flavored liquid concentrate, and mixing water with a controlled amount of the selected flavored liquid concentrate to produce a single beverage output using the venturi chamber. The output as a single beverage from the venturi chamber is dispensed using a flexible hose and nozzle assembly.

Another embodiment of the invention entails the use of a beverage base and sweetened flavoring for beverage making such that a pair of input lines are employed to the venturi mixing device.

The structure that houses the venturi mixing device, associated inputs, outputs, etc. can be made to rotate on a horizontal or vertical axis to facilitate at least dispensing of the beverage. The water being supplied can also be pressurized at the dispensing system itself, and this capability is advantageous when pressurized water, e.g., city water, is unavailable.

BRIEF DESCRIPTION OF THE DRAWINGS

Reference is now made to the drawings of the invention wherein.

DESCRIPTION OF THE PREFERRED EMBODIMENTS

The present invention offers significant improvements in the field of beverage dispensing. The system can produce a high output of beverage, which can be one or more of plain, sweetened and/or flavored. The system uses water as its motive force, so there is no need for gas or other means to achieve dispensing. The system is compact in nature so that it can be easily installed or is mobile, and has controls to allow an operator to select the ratios or amounts of the various beverage components for a desired beverage taste. By having a single beverage outlet, the cost of the system is drastically reduced as compared to a dispensing system employing multiple outlets.

Figure 1:
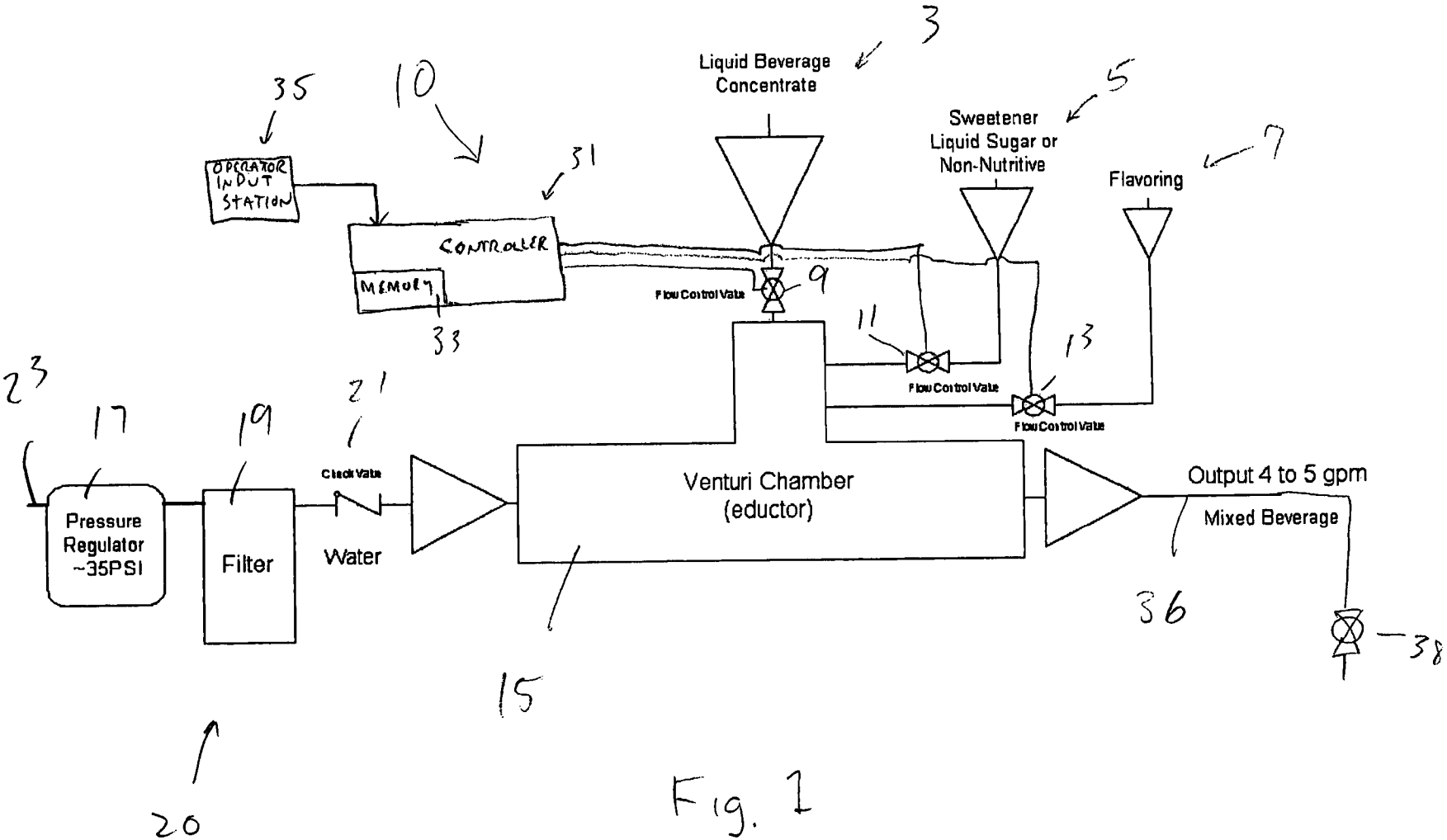
FIG. 1 is a schematic view of an exemplary system of the invention.

One embodiment of the system is depicted in FIG. 1 as reference numeral 10. The system uses a number of beverage components to produce a single beverage output. A first source 3 is a liquid beverage concentrate or base, which can be virtually any concentrated beverage, but is preferable tea, fruit juice, or a synthetic concentrate that imitates these liquids. A second source is a liquid sweetener 5, which can be sugar in water, or a non-nutritive sweetener such as NutraSweet® and a saccharin-based type. A third source is a flavoring 7, e.g., a fruit flavoring such as peach, or a flavoring such vanilla, hazelnut, and the like. Each source is equipped with its own control valve, valve 9 for the beverage concentrate or base 3, 11 for the sweetener 5, and 13 for the flavoring 7.

Each of the valves 9, 11, and 13 are disposed between their respective liquid source and a venturi mixing device 15. Since these types of mixing devices are well known, a description of how they operate is not necessary for understanding of the invention. The valves 9, 11, and 13 are intended to represent a single valve, which is both an on-off valve and a control valve (like a shower valve), or a two valve arrangement wherein an on-off valve and a control valve coact for total operation. While the device 15 is shown with the control valves separate, the control valves could be made part of the device as is shown in U.S. Pat. No. 4,610,512 to Cleland and U.S. Pat. No. 4,042,151 to Uttech. In yet another mode, the valves as part of the mixing device could be both for control and on/off operation. Regardless of the various valve configurations contemplated by the invention, the valves ultimately function to control the flow of the beverage components for mixing in the device 15 by being positioned between the source of the beverage component and the part of the venturi mixing device 15, e.g., the venturi chamber itself.

The system 10 also employs a water supply assembly 20 that comprises a pressure regulator 17 (preferred to regulate to 25–45 psi and optimally at around 35–40 psi), optionally a filter 19, and a check valve 21. A source of water, preferably city water, is identified by numeral 23. In certain instances, the source of water will already be filtered, and there is no need for the filter 19. The components of the assembly 20 can be mounted together on a support structure, e.g., a plate, (not shown) and the support structure (plate) can then be mounted (by bolts adhesive, etc.) where appropriate so that an easy connection to the city water source 23, and to the venturi mixing device 15 can be made. Removal of the plate allows for removal of the entire assembly 20. A gate or other type on/off valve could also be employed as part of the assembly 20 to interrupt mixing and effectively shut down the operation without having to remove the motive supply line. The assembly 20 can also include standard or quick-connect couplings to ease connection to city water and the device 15.

Instead of city water, a source or pressurized water could be used to supply the water to the apparatus, e.g., pressurized water in a tank, or a system that allows a user to pressurize the water for use in the dispensing operation.

The sources of beverage components 3, 5, and 7 can be provided as concentrates in box or other container form. When using containers, another support structure can be provided that will house and/or support the containers, the valves, the mixing device, and other miscellaneous hardware so that the system is essentially a one-piece design that can be installed on a table or like, and hooked to city water via the separately mounted assembly 20. Preferably, the support structure employs a housing, which encases the various containers, venturi mixing device, controls, etc. so that only the control features are exposed for operation during normal use. Alternatively, the sources of beverage component can come from a remote location if desired, one that is not in the vicinity of the system itself, and is conveyed through piping or the like.

Hoses and quick connect couplings can be employed in the system 10 where appropriate, e.g., between the various sources 3, 5, and 7 and the control valves 9, 11, and 13 or venturi mixing device 15, between the water assembly 20 and the device 15. Preferably, all inflow and outflow connections to the system will be quick connect types, and if desired, can also include positive leak locks so that all liquid flow is stopped when the connection is removed. Check valves can be employed where appropriate to control back flow of liquid. A check valve(s) (not shown) are also employed between the venturi mixing device and the various beverage components to prevent backflow and cross contamination.

The venturi mixing device 15 is designed to produce a high output of beverage that would be required for prisons, hotels, restaurants, food service companies, or the like. In one mode, the output should be on the order of 8–12 ounces per second of final beverage with a target of around 10 ounces per second. In another and lower output as described below, the output to the beverage container can be as low as 2.0 ounces per second, and preferably be around 3.2 to 5.0 ounces per second (around 1.5 to 2.5 gpm). As also explained below, more diffuse output can also be generated to reduce splashing.

FIG. 1 also shows a controller 31. The controller 31 controls the operation of the valves 9, 11, and 13 based on the input water supply 23. The valves and controller can be any known type to effect mixing of the various source liquids and water. That is, the controller would provide the appropriate signal to the valve for opening or closing to allow the appropriate flow of liquid to the venturi mixing device 15. The valve would be the type capable of responding to this signal and adjusting the valve opening to meter flow into the venturi mixing device 15. By controlling the individual flows of the beverage components, the controller 31 controls the ratio of the concentrate, sweetener, and flavorings to each other and to the water entering the device 15. As an example, based on the viscosities of the concentrate, the liquid sweetener, and the flavoring, a ratio could be 20:1:0.1 wherein twenty parts of a tea concentrate are mixed with 1 part of sweetener, and 0.1 parts of peach flavoring are mixed with one part of water to produce a single output of peach flavored sweetened tea at 36. The output is preferably controlled with a nozzle wherein the nozzle has a lever for control of dispensing of beverage. The output nozzle and valve are represented by reference numeral 38. Of course, other techniques can be used to control the flow of output 36 as would be within the skill of the artisan. The controller 31 can be designed such that pressing a particular button or key selects a beverage that has preset ratios of components, e.g., sweetened peach flavored tea. Once the particular type of beverage is selected, the nozzle lever is depressed and a beverage is dispensed into the appropriate container(s). Alternatively, a control key can be provided to let the operator determine whether the beverage is sweetened or not. Other control features as would be within the skill of the art can also be employed.

The controller 31 is also equipped with a memory 33 so that a particular ratio of components can be remembered, and then assigned an identifier. Once the identifier is established, only the identifier has to be called up to replicate the peach-flavored sweetened tea. Also provided is an operator input station 35, e.g., a touch pad or the like, wherein beverage selection, ratios etc. can be controlled for beverage dispensing. It should be understood that the controller, memory, and operator input are conventional control items, and given the intended purpose of controlling the flow of the various beverage components through the control valves, the actual design of the controller, memory use, and operator input station 35 is within the skill of the artisan.

One configuration of the system would be one base tea (or one or a number of fruit juices), one sweetener, and a number of different flavorings. As detailed below, the sweetener and flavoring can be combined into one input.

The system does not require $CO_2$ or another motive force, just water such as that typically available at a commercial facility like a hotel. The system could also employ manual override controls of the various control valves 9, 11, and 13 so that if the controller 31 malfunctioned, the valves could be opened or closed manually to produce a desired beverage.

Figure 2:
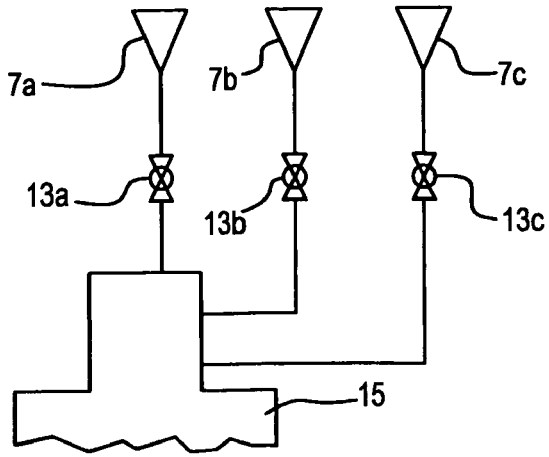
FIG. 2 is a partial schematic of another embodiment of the system of FIG. 1.

FIG. 2 shows a partial schematic of an alternative embodiment wherein a number of flavoring sources are used, 7*a*, 7*b*, and 7*c*. Each flavoring has its own control valve 13*a*, 13*b*, and 13*c* for inputting more than one flavoring into the venturi mixing device 15. A similar arrangement could be employed for the sweetener source wherein one source would be sugar water, a second source would be a saccharin-containing liquid, and the third source would be an aspartame-containing liquids. In yet a further mode, when using only one source at a time, a number of sources could be employed, each one with its one on/off valve. These sources could then share a single control valve. For example, if three sweetener sources are provided, each would have an on/off valve, and each on/off valve would be in communication with a control valve. A sugar water source intended for use would have it on/off valve open, and the other two source on/off valves would be closed. The sugar water would feed to the control valve for beverage making and dispensing.

While the system 10 is primarily designed for a high volume output, 8–12 ounces per second (optimally 10 ounces per second), a venturi mixing chamber 15 and valves could be configured to output a lower volume of material, e.g., around 3.2–5 ounces per second. As described below, the system can also have the capability to provide high and low or more diffuse output flows so that a user has more flexibility in filling containers of various sizes using lower flows or lower velocities.

Figure 3:
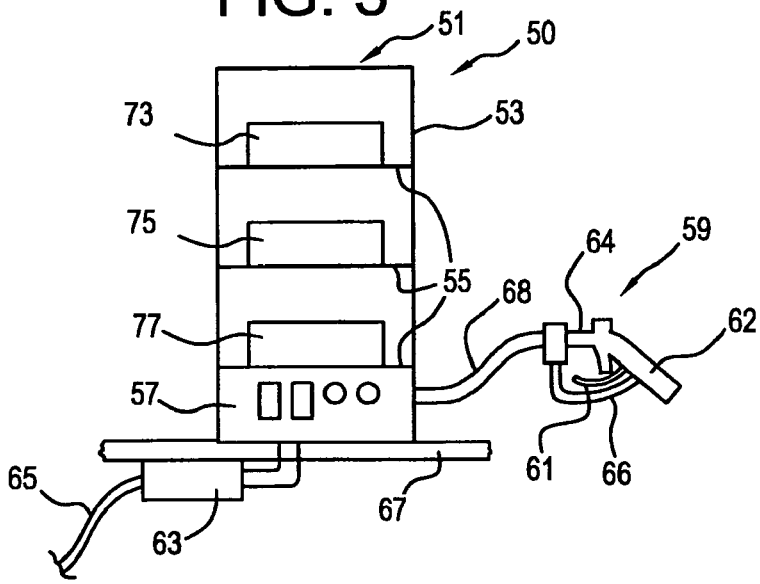
FIG. 3 is a schematic of an exemplary support structure for the inventive system.

FIG. 3 shows an exemplary arrangement 50 of the system 10. A support structure 51 has a housing 53, and lateral supports 55. Each support holds a beverage mix source, e.g., the beverage base container 73, the sweetener container 75, and the flavoring container 77. Controls are located on panel 57 for setting the beverage taste and sweetness level, or selecting a pre-set taste. The nozzle 59 controls dispensing via lever 61. The nozzle 59 includes an elongated tubular end piece 62 with an opening at an end thereof, the end piece adapted to be positioned near or in an opening of a container desired to be filled, e.g., a pitcher, punch bowl, glass or the like. The nozzle also has a grip portion 64 whereby a user could grasp the lever 61, and can have, if so desired, a protecting member 66 which forms a space to allow the lever 61 to be gripped, and at the same time, protects a use's hand during a filling operation. The flexible hose 68 can be of any length, but it is preferred to be of sufficient length, e.g., 3–6 feet or so, so that the containers do not have to be brought to the actual system for filling.

Also shown in FIG. 3 is a water supply assembly 63 disposed between a source of water 65 and the system 50, and supported by a table or the like 67. The table 67 also provides support for the system 50. As noted above, the water supply assembly is separately mounted from the structure 51 for ease of removal. If desired, the assembly 63 could be made part of the system 50 so that it is supported by the structure 51 and removable as a single unit.

Figure 4:
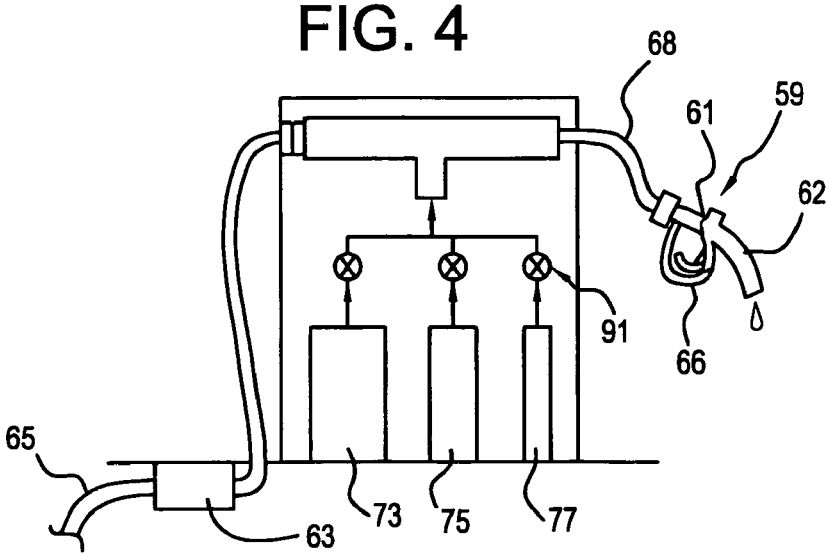
FIG. 4 is a schematic of an inverted system.

FIG. 4 shows an inverted configuration wherein the venturi mixing device 15 is positioned above the containers 73, 75, and 77. In this configuration, gravity acts as an aid to minimize or eliminate cross contamination between the various beverage components. The inverted configuration also reduces syrup drip down onto various pieces of equipment. The entire assembly can be cart mounted for total mobility, with such mobility favoring situations where multiple service areas are present, e.g., hospitals, college campuses, sport venues, etc.

In another mode, the dispensing valve 38 could be positioned at or near the outlet of venturi mixing device 15. This minimizes the amount of beverage in the hose between the device 15 and the dispensing valve. This is beneficial in instances where the beverage taste may be altered between sessions of dispensing. With a great distance between the outlet of the valve 38 and the outlet of the device 15, a considerable amount of beverage must be purged. If a number of different mixings and dispensing are be done, a significant amount of purging may occur, which not only slows down the operation but wastes materials. Minimizing the distance between the outlet of the valve 38 and the device 15 minimizes both waste and loss of time for purging.

Figure 5:
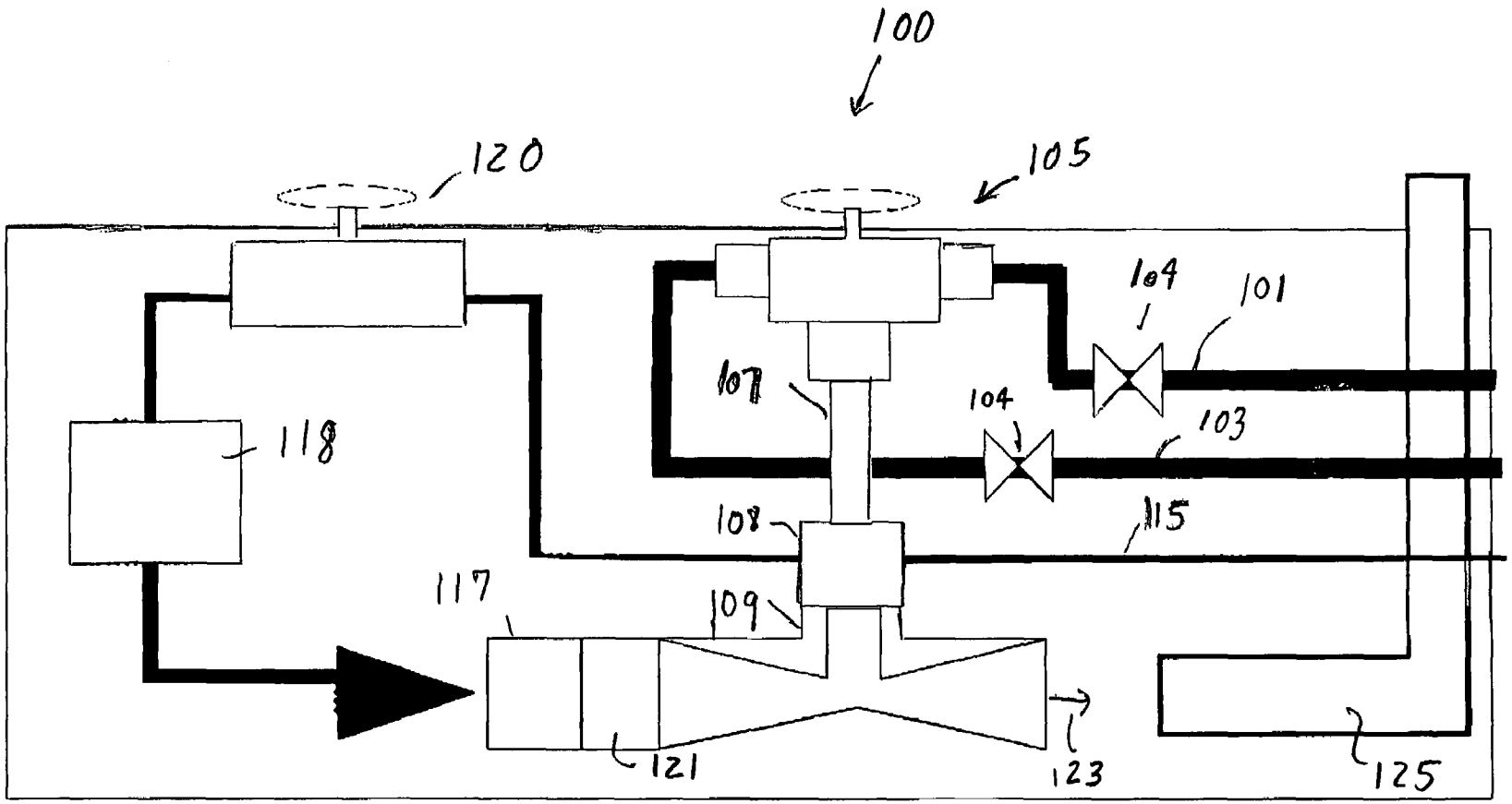
FIG. 5 is a flow diagram of an alternative system for dispensing liquids at a high rate.

In another embodiment, the dispenser is designed to use a liquid concentrate that is pre-flavored and sweetened rather than using input liquids that may comprise separate flavorings and sweeteners along with a concentrate. This embodiment offers the advantages of a simpler design in that the controller and valve arrangement for mixing the concentrates, sweeteners, and flavorings is eliminated. This dispenser assembly is shown in FIG. 5 and is designated by the reference numeral 100. The dispenser 100 includes a pair of input lines 101 and 103, each having flow control valves 104, each of which being disposed upstream of a switching valve 105. The input lines receive concentrated beverages that merely need dilution for consumption. Output of the switching valve travels via line 107 to the input of the venturi valve 109, with a check valve 108 disposed between the valve 105 and the venturi valve 109. The concentrate is pre-flavored and sweetened so that only a single source of liquid is required to produce the desired output of drink.

In a preferred mode, the lines 101 and 103 are of different diameters so that different viscosity concentrates can be used. By having a larger diameter input line, a higher viscosity concentrate, e.g., one containing sugar rather than a liquid sweetener, can be employed. At the same time and because of the presence of the smaller diameter line, a lower viscosity concentrate can also be readily used.

Water is supplied to the venturi valve 109 via input line 115 and this aspect of system 100 is basically the same design as used with the embodiment of FIGS. 1–4. Check valve 117 is disposed upstream of the venturi water inlet 119 to prevent backflow, and a pressure regulator 118 and on/off valve 120 is provided to control the pressure to the venturi valve 109. Likewise, a control valve 121 is disposed upstream of the venturi valve 109 to allow control of water flow thereto.

The system 100 has an output 123 which is the finished beverage and which is dispensed using a nozzle represented by 125, such as the flexible hose 62 and nozzle 59 as shown in FIG. 4, and provides the same advantage in that a number of different types of containers, punch bowls, pitchers, etc. can be easily and quickly reached and filled. This is especially advantageous when the container may be difficult to move and it is easier to bring the flexible hose and nozzle to the container for filling.

The system of FIG. 5 can also incorporate the features of the system of FIG. 4, e.g., minimum length between dispensing valve and venturi to minimize purging problems and the like. The electronic controls described in connection with the embodiment of FIGS. 1–4 are also equally applicable for the FIG. 5 system in that the rate and selection of beverage concentrate could be controlled to produce a desired output.

Another embodiment of the invention entails use of an alternative dispensing arrangement. Whereas FIGS. 3 and 4 shows a hose and nozzle assembly, the mixed beverage can be dispensed using just a dispensing valve, see FIG. 1, such as one that would have a toggle lever or the like. Beverage could be dispensed directly into a container using this valve or one end of a hose could be connected to the end of the valve with the beverage being discharged from the other end of the hose into a container.

In addition, other types of metering devices for control of flow of fluid could be employed. While control valves are illustrated in FIG. 1, fixed or replaceable orifices could be utilized in one or more of the lines having fluid flowing therethrough. In fact, any type of flow control device could be employed for fluid flow control in the dispensing device of the invention.

Figure 6:
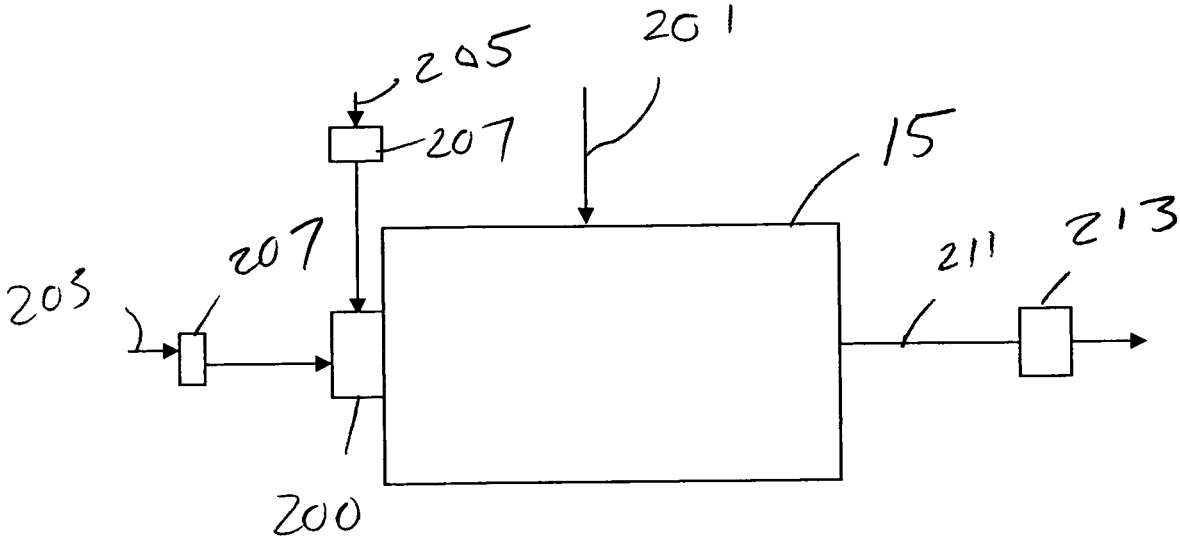
FIG. 6 is a schematic representation of another embodiment of the system using two input lines for beverage mixing and dispensing.

In yet another alternative, the sweetener and flavoring could be combined as one input into the venturi, rather than separate inputs as shown in FIG. 1. In this embodiment, two sources of liquid would be employed for input to the venturi, one being the beverage base input adapted to connect to a source of beverage base such as a bag or the like, with the other one being a sweetened flavoring input adapted to connect to a sweetened flavoring in a container such as a bag. Of course, the other one could be just a flavoring or sweetener as well. This embodiment is shown in FIG. 6, wherein a venturi mixing device 15 is shown with a check valve 200. Water input to the venturi mixing device 15 is shown as 201, with the liquid beverage base being inputted at 203. The flavoring/sweetener source input is shown at 205, with the control device for each input line identified as 207. Although not shown, a source of the beverage base, e.g., a bag or other container, is in communication with input line 201 with a source of a flavoring, sweetener, or flavoring/sweetener combined in communication with input 205. The input lines 201 and 203 are shown going into a check valve 209. If so desired, each line could have its own check valve and own entry into the venturi mixing device 15, i.e., a multiple inlet venturi. The output 211 of the venturi mixing device 15 passes through dispensing valve 213 prior to filling a container such as a pitcher or the like.

In another aspect of the invention, other additives could be included in the beverage base, sweetener/flavoring, sweetener, or flavoring, such as vitamins, mineral supplements or the like. In addition, the beverage base could be coffee instead of tea or juice, or any other beverage base suitable for dilution with water.

Also, while pressure regulated water can be employed, a regulator may not be required if the water is coming from a source of known pressure, e.g., a tank of pressurized water. Alternatively, a device could be provided that allows for pressurization of water by a user at the dispenser system itself. For example, the device could be equipped with a pump mechanism that would pressurize enough water to fill a desired container. Once the water is pressurized, the pressurized water could then be employed as the motive force for mixing and dispensing of the beverage.

Figure 9:
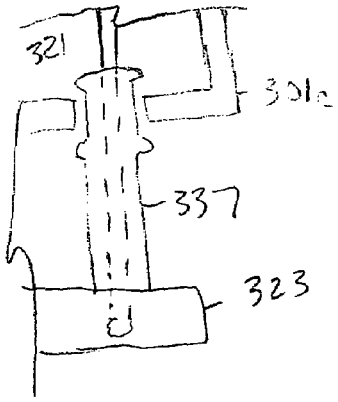
FIG. 9 is a schematic drawing showing a structure that has can rotate on a vertical axis.
Figure 8:
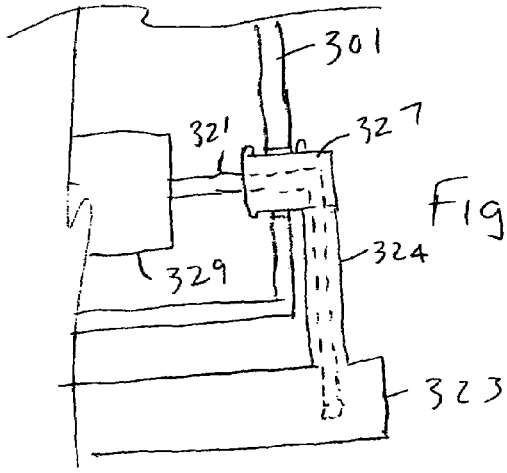
FIG. 8 is a schematic drawing showing more detail regarding the pivoting structure of FIG. 8 and its water supply.
Figure 7:
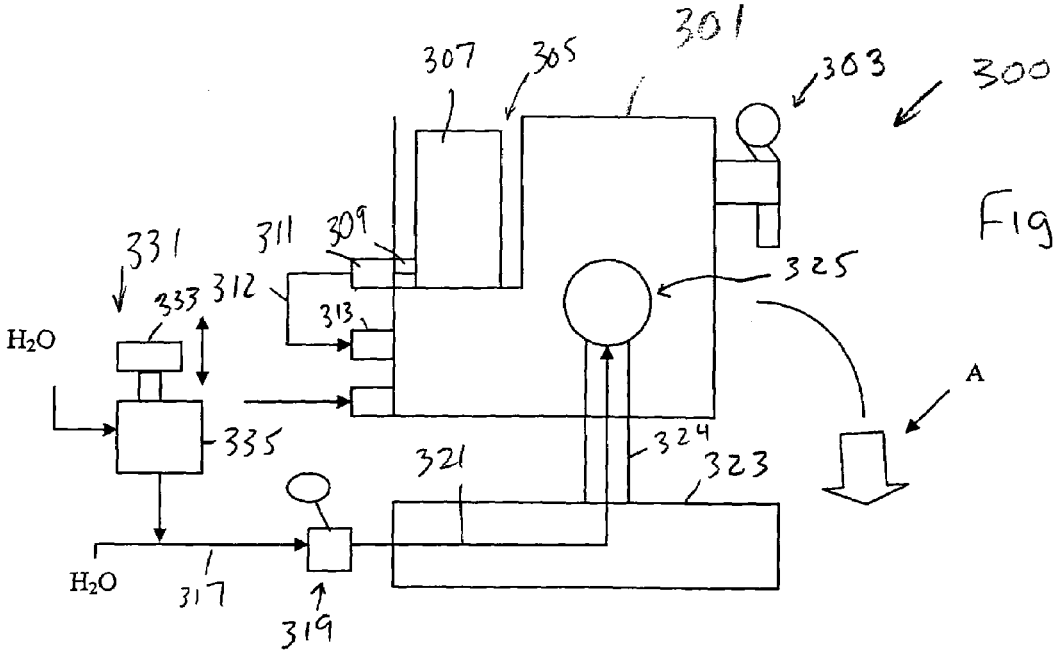
FIG. 7 is a schematic of another embodiment of the invention that entails a pivoting structure.

FIGS. 7–9 show another embodiment of the invention designated by the reference numeral 300 and which also utilizes a supporting structure. This supporting structure for the venturi mixing chamber, control devices etc. as described above is shown as 301. A dispensing tap is provided as 303. Since the details of the connections between the various components are described above, they are omitted for this embodiment. The structure or housing 301 has a chamber 305 adapted to receive a container 307 having the beverage base therein. While the container 307 is shown as a rigid container, it could be a flexible bag, as is used in boxes of wine. The container 307 has a fitment 309 which allows egress of fluid from the container 307. A complementary fitment 311 and hose designated as 312 connects the fitment 309 to an input 313 to the housing 301. Alternatively, the hose 311 can act as the input line and enter the housing for connection to the venture mixing device. Of course, any known connection can be employed to provide communication between the beverage base container 307 and venturi mixing device. Another input 315 is provided that would allow connection to another source of liquid, e.g., flavoring, sweetener, flavored sweetener or any other liquid that could be used with the base beverage.

The chamber can be shaped to enhance the discharge of liquid from the container 307 if so desired. For example, when using a flexible bag, the housing can have curved or other-shaped surfaces to channel the fluid into the fitment 309.

A water input is designated as 317, which is supplied to the housing 301 via on/off valve 319. A check valve in conjunction with the water supply is also preferably used, although not shown. The water input travels through a line 321 in the base 323. The base 323 has a pair of legs 324 (one shown) that supports the housing 301 via a pivotal connection 325. This pivotal connection allows the housing to rotate as shown by arrow A, as described in more detail below. The water line 321 travels within the pivotal connection, which can be formed by making the housing 301 into two pieces. Referring to the schematic of FIG. 8, one half of the housing as segment 301*a* is shown surrounding a shaft 327. The other half of the housing segment (not shown) connects with the other segment 301*a* while surrounding the shaft 327. The housing segments can freely pivot on shaft 327 while the water line 321 passing through the stationary interior of the shaft 327 to supply the venturi mixing device 329 with water. Of course, the appropriate bearings or other structure can be implemented to facilitate the pivoting movement of the housing 301.

The ability of the housing to rotate makes it easier to dispense beverages from the dispensing tap 303, as well as facilitating loading of the container of beverage base.

FIG. 7 also shows a separate water pressurization device 331. Here, a pump 333 would be used to pressurize water in the container 335 and the pressurized water could then be supplied to the water valve 319 for use in beverage mixing and dispensing. These types of devices are commonly found in toy squirt guns, and a further description thereof is not deemed necessary for understanding of this aspect of the invention. Of course, other known types of water pressurization devices could be employed in place of a source of already pressurized water such as city water. Also and although the means to pressurize water is shown separate from the base or housing, the base or housing could support such a means.

Yet another alternative would be to mount the housing on a single support so that it can rotate about a vertical axis rather than a horizontal axis as shown in FIGS. 7 and 8. Referring to FIG. 9, the base 323 is equipped with a single leg 337, and the housing is again split into two segments, one shown as segment 301*c*, to connect to the leg 337 for rotation thereabout. The leg would have the necessary bearing or other structure to secure the housing 301 to it. The water line 321 would enter the interior of the housing through the leg 337 for attachment to the venturi mixing device (not shown).

While one example of rotation about a horizontal or vertical axis is shown, other ways to effect this rotation can be employed without departing from the invention.

Figure 10:
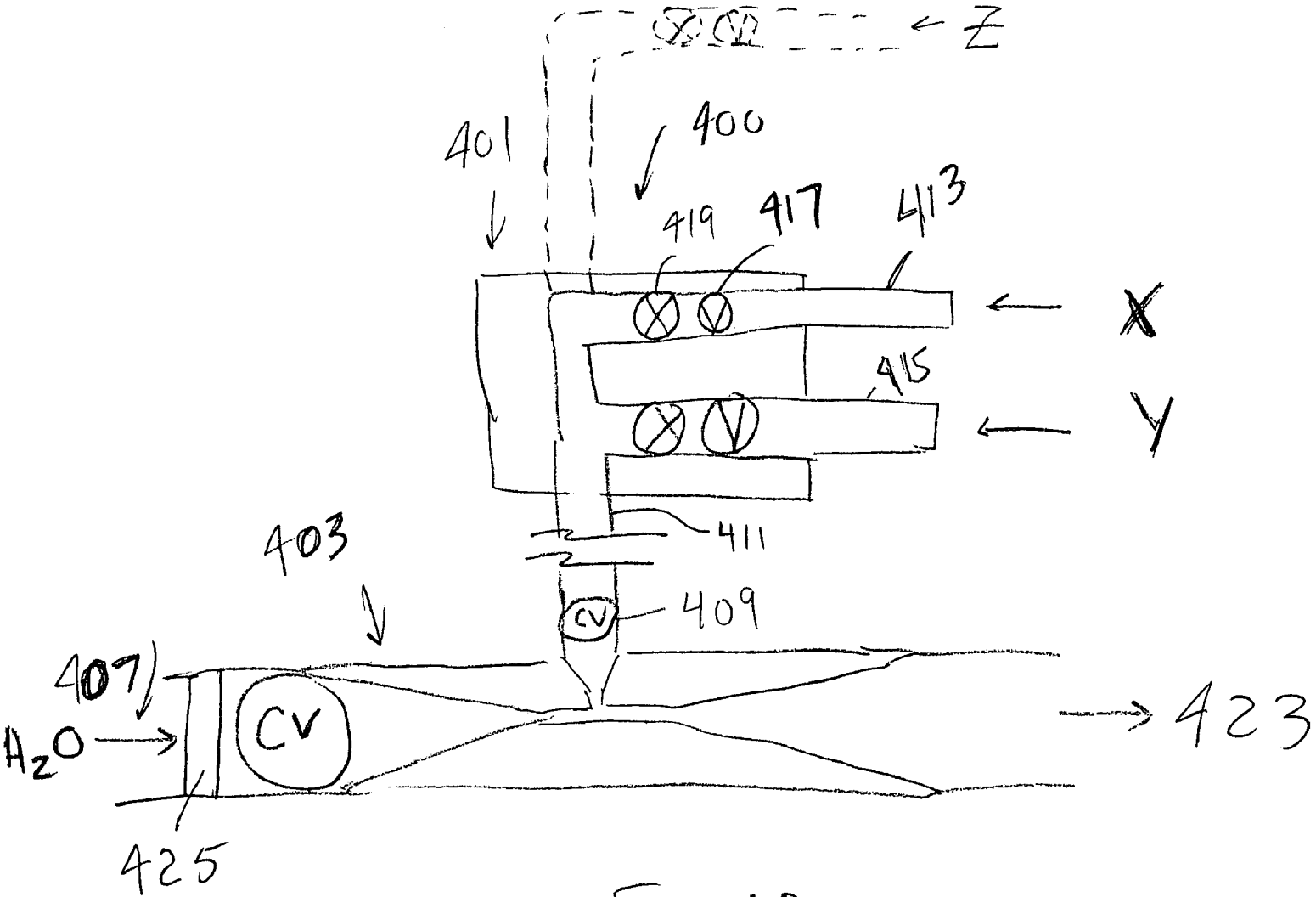
FIG. 10 is a schematic drawing showing an overall flow diagram for the invention.

FIG. 10 is another schematic illustration of the invention represented by the reference numeral 400. This illustration is intended to more clearly show the ability to mix at least two different streams of liquid with on/off control or adjustable rate control. Therein, a control 401 is shown in association with the venturi mixing device 403. The mixing device 403 has a check valve 405 and water input 407. A flow restrictor 425 can also be employed in conjunction with the water input 407.

The input to the venturi mixing device 403 has a check valve 409, indicated as "CV," and a line 411 of desired length between the control 401 and the venturi mixing device 403. The control 401 has lines 413, 415 to adjustably direct two sources of liquid X and Y into the control and to the venturi mixing. Source X is preferably the liquid beverage base source, with Y being one of an unsweetened liquid flavoring, a sweetened liquid flavoring or a cleaner. Additional lines could be provided to input other liquids such as alcohol, additional flavorings, either unsweetened or sweetened, or sweeteners. One additional line with source Z is shown in cross hatch, but any number of additional lines could be employed.

The control 401 has a control valve 417, e.g., a needle valve or the like and on/off valve 419 in each of line 413 and 415. Downstream of each of the on/off valves 419, the liquids X and Y merge as mixture 421, the mixture passing 421 through the line 411 and check valve 409 prior to entering the venturi mixing device 403. The water from source 407 and beverage mixture 421 enter the venturi and product output 423 is produced for use. The valves may be any type, mechanical, electromechanical, solid state or the like. While the control valve and on/off valve are shown separate, a single valve could be used for on/off and control of flow functions.

With the arrangement and valves 419 open and valves 417 set to the proper ratios, X and Y can be mixed with water to produce a desired beverage, with flavoring and sweetening, if desired. Closing valves 419 will produce an output of water alone. The device can be cleaned by providing a cleaning liquid through lines 413 and/or 415.

As such, an invention has been disclosed in terms of preferred embodiments thereof, which fulfills each and every one of the objects of the present invention as set forth above and provides new and improved beverage dispensing method and system.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a system of dispensing beverages using water as a motive force and a venturi mixing device to mix the water with a beverage base to produce a beverage output, the improvement comprising a system having:

at least one liquid beverage base input line with a first control device disposed upstream of a venturi chamber of a venturi mixing device, at least one liquid beverage base input line adapted to connect at least one liquid beverage base source with the venturi chamber; or at least one liquid beverage base input line and at least one liquid beverage sweetener and/or flavoring input line with a second control device disposed between the venturi chamber of the venturi mixing device, at least one liquid beverage sweetener and/or flavoring input line adapted to connect at least one liquid beverage sweetener and/or flavoring source with the venturi chamber;

a single beverage outlet from the venturi mixing device having a dispensing valve;

a water input connected to the venturi mixing device for supplying pressurized water as the motive force for both mixing of the at least one beverage base or the at least one beverage base and the at least one liquid beverage sweetener and/or flavoring and the water to form the beverage, and propelling the beverage from the venturi mixing device to an outlet of the dispensing valve;

means for controlling the taste of the beverage output by controlling input into the venturi chamber; and a unit sized to be portable and easily moved, the unit enclosing the venturi mixing device and including a chamber to retain the at least one liquid beverage base source, the unit also having the water input and the dispensing valve mounted thereto.

2. The system of claim 1, wherein the control means includes a memory means for remembering ratios of beverage base and sweetener and/or flavorings for a particular beverage flavor, and means for replicating said particular beverage flavor using the remembered ratios.

3. The system of claim 1, wherein the venturi chamber is capable of producing a high volume beverage output flow on the order of least about 3.2–12 ounces per second.

4. The system of claim 1, wherein at least one liquid beverage flavoring input line is adapted to connect at least one liquid beverage sweetened flavoring source to the venturi chamber.

5. The system of claim 1, wherein the control device is one of a valve or orifice adapted to control flow or the combination of a valve or orifice for control and an on/off valve.

6. The system of claim 1, wherein the portable unit further comprises a supporting structure that has a base which has a support that allows the supporting structure to rotate on a horizontal axis.

7. The system of claim 6, wherein the water input is in communication with the venturi mixing device through the base and support.

8. The system of claim 1, further comprising means for pressurizing water for input to the water input line, the pressurizing means associated with the unit.

9. The system of claim 1, comprising both the at least one liquid beverage base input line and the at least one liquid beverage sweetener and/or flavoring input line.

10. A method of dispensing beverages using a venturi chamber, a source of a liquid beverage base, and water for mixing with the liquid beverage base comprising:

providing at least a source of a liquid beverage base or providing at least a source of a liquid beverage base and at least one source of a liquid flavoring and/or sweetener;

providing a unit sized to be portable and easily moved and having a chamber to retain at least the source of the liquid beverage base; and mixing water with controlled amounts of the liquid flavoring and/or sweetener and/or liquid beverage base to produce a single beverage output using the venturi chamber, and outputting a single beverage from the venturi chamber using a valve, the outputting step further comprising using the water as a propelling force to output the single beverage from an outlet of the valve mounted on the portable unit.

11. The method of claim 10, comprising providing at least one source of a sweetened liquid flavoring and a source of the beverage base.

12. The method of claim 10, wherein the output is a high volume output of at least about 3.2–12 ounces per second.

13. The method of claim 10, wherein the water is pressurized just prior to the mixing step.

14. In a system of dispensing beverages using water as a motive force and a venturi mixing device to mix the water with a beverage base to produce a beverage output, the improvement comprising a system having:

at least one of a liquid beverage base input line with a first control device disposed upstream of a venturi chamber of a venturi mixing device, at least one liquid beverage base input line adapted to connect at least one liquid beverage base source with the venturi chamber and a liquid beverage sweetener and/or flavoring input line with a second control device disposed upstream of the venturi chamber of the venturi mixing device, at least one liquid beverage sweetener and/or flavoring input line adapted to connect at least one liquid beverage sweetener and/or flavoring source with the venturi chamber;

a water input connected to the venturi mixing device for supplying pressurized water as the motive force for operation of the venturi mixing device;

a single beverage outlet from the venturi mixing device having a dispensing valve;

means for controlling the taste of the beverage output by controlling input into the venturi chamber, and a supporting structure adapted to contain the at least one beverage base source or a combination of the beverage base source and the sweetener and/or flavoring source or sources, the supporting structure rotating on a horizontal axis.

* * * * *